United States Patent [19]

Blaser

[11] 4,062,760

[45] Dec. 13, 1977

[54] DRY FINES RECYCLE IN A COKING PROCESS

[75] Inventor: Don E. Blaser, Randolph, N.J.

[73] Assignee: Exxon Research and Engineering Company, Linden, N.J.

[21] Appl. No.: 678,626

[22] Filed: Apr. 20, 1976

[51] Int. Cl.[2] ..... C10G 9/32; C10J 3/16

[52] U.S. Cl. ..... 208/127; 48/197 R; 208/161

[58] Field of Search ..... 208/127, 161; 48/197 R

[56] References Cited

U.S. PATENT DOCUMENTS

| | | | |
|---|---|---|---|
| 2,362,270 | 11/1944 | Hemminger | 208/127 |
| 2,773,811 | 12/1956 | Nicholson et al. | 208/127 |
| 2,846,374 | 8/1958 | Jahnig | 208/127 |
| 3,414,504 | 12/1968 | Oldweiler | 208/127 |
| 3,475,323 | 10/1969 | Stuckey et al. | 208/127 |
| 3,702,516 | 11/1972 | Luckenbach | 208/127 |

FOREIGN PATENT DOCUMENTS

| | | | |
|---|---|---|---|
| 566,631 | 11/1958 | Canada | 208/127 |

*Primary Examiner*—Herbert Levine
*Attorney, Agent, or Firm*—Marthe L. Gibbons

[57] ABSTRACT

In a coking process wherein a stream of fluidized solids is passed from a fluidized bed coking zone to a second fluidized bed, entrained coke fines recovered from the gaseous effluent of the second fluidized bed zone are recycled as dry fines to the coking zone.

16 Claims, 1 Drawing Figure

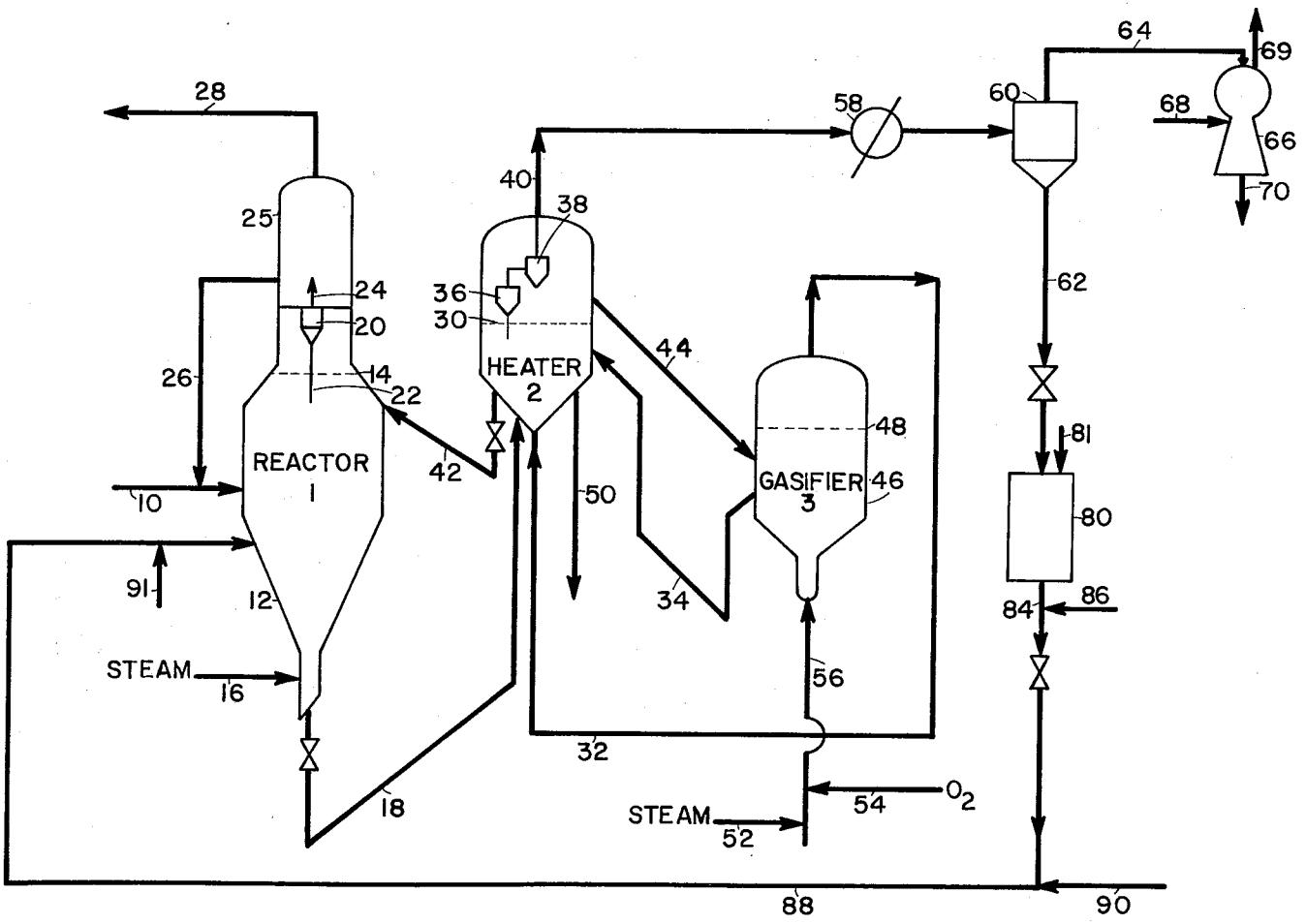
REACTOR 1
HEATER 2
GASIFIER 3
STEAM
STEAM
$O_2$

DRY FINES RECYCLE IN A COKING PROCESS

BACKGROUND OF THE INVENTION

1. Field of the Invention

This invention relates to an improvement in a fluid coking process. More particularly it relates to recycling dry coke fines to the coking zone of the process. The term "fines" is intended herein to designate particles having a diameter size ranging up to about 74 microns.

2. Description of the Prior Art

It is known to produce fuel gases by integrated fluid coking and gasification processes such as those disclosed in U.S. Pat. Nos. 3,661,543; 3,702,516; and 3,759,676, the teachings of which are hereby incorporated by reference.

U.S. Pat. No. 3,414,504 discloses a fluid coking process in which a burner feul gas including entrained coke is combusted with air thereby producing heated dry coke particles which are recycled to the coker directly or in admixture with the oil feed.

U.S. Pat. No. 3,278,412 discloses a process for fluid coking in which coke-coated tar sands fines recovered from a low temperature burner are burned to remove the coke therefrom and the coke fines are subsequently recycled to a coking zone.

It is also known that a fluid coking process has been operated commercially with recycle of the dry coke fines removed from the coke burner to the coker by slurrying the dry fines with the coker oil feed prior to injecting the fines into the coker. Heretofore, it was assumed that if dry coke fines were recycled to the fluid coker, a large portion of the fines would escape overhead to the scrubber. The increased solids concentration in the slurry from the scrubber could then lead to plugging of the slurry circuit.

It has now been found that dry fines recovered from the gaseous effluent of a zone integrated with the coking zone can be advantageously recycled to the coking zone as dry fines without the necessity of mixing the fines with the coker oil feed, and without adversely affecting the process operation including the particle size distribution of the fluidized solids. Furthermore, in one embodiment of the invention wherein the process is an integrated coking and gasification process, the recycle fines permit a higher level of gasification of the gross coke product than heretofore. Recycling the fines also eliminates the coke fines disposal problem.

SUMMARY OF THE INVENTION

In accordance with the invention, there is provided in a coking process comprising the steps of: (a) contacting a carbonaceous material under fluid coking conditions in a coking zone containing a first bed of fluidized solids to form coke, said coke depositing on said fluidized solids; (b) introducing a portion of said solids with a coke deposition thereon to a second zone containing a second bed of fluidized solids; (c) recovering from said second zone a gaseous stream containing entrained solid fines; and (d) separating from said gaseous stream at least a portion of said entrained fines as dry fines; (e) the improvement which comprises mixing said separated dry fines with a gas, and (f) introducing the resulting mixture of dry fines and gas into said coking zone at a velocity of at least 25 feet per second.

BRIEF DESCRIPTION OF THE DRAWING

The FIGURE is a schematic flow plan of one embodiment of the invention.

DESCRIPTION OF THE PREFERRED EMBODIMENTS

The dry fines recycle process of the invention is applicable generally to a fluid coking process which comprises a fluid coking zone and at least a second fluidized bed zone from which is removed a gaseous stream containing entrained coke fines. The second fluidized bed zone may be a heating zone, such as a combustion zone, for example, the fluidized bed of a conventional coke burner, or the second fluidized bed zone may be a heat exchange zone, or the second fluidized bed may be a gasification zone. The preferred embodiment will be described with reference to the accompanying figure.

Referring to the FIGURE, a carbonaceous material having a Conradson carbon residue of about 22 weight percent, such as heavy residuum having a boiling point (at atmospheric pressure) of about 1,050° F.+ is passed by line 10 into a coking zone 12 in which is maintained a fluidized bed of solids (e.g. coke particles of 40 to 1000 microns in size) having an upper level indicated at 14. Carbonaceous feeds suitable for the present invention include heavy hydrocarbonaceous oils; heavy and reduced petroleum crudes; petroleum atmospheric distillation bottoms; petroleum vacuum distillation bottoms; pitch, asphalt, bitumen, other heavy hydrocarbon residues; coal; coal slurry; liquid products derived from coal liquefaction processes, and mixtures thereof. Typically such feeds have a Conradson carbon residue of at least 5 weight percent, generally from about 5 to about 50 weight percent, preferably above about 7 weight percent (as to Conradson carbon residue, see ASTM test D-189-65). A fluidizing gas, e.g. steam, is admitted at the base of coking reactor 1 through line 16 in an amount sufficient to obtain superficial fluidizing gas velocity in the range of 0.5 to 5 feet per second. Coke at a temperature above the coking temperature, for example, at a temperature from about 100 to 800 Farhenheit degrees in excess of the actual operating temperature of the coking zone is admitted to reactor 1 by line 42 in an amount sufficient to maintain the coking temperature in the range of about 850° to about 1400° F. The pressure in the coking zone is maintained in the range of about 5 to about 150 pounds per square inch gauge (psig), preferably in the range of about 5 to about 45 psig. The lower portion of the coking reactor serves as a stripping zone to remove occluded hydrocarbons from the coke. A stream of coke is withdrawn from the stripping zone by line 18 and circulated to heater 2. Conversion products are passed through cyclone 20 to remove entrained solids which are returned to the coking zone through dipleg 22. The vapors leave the cyclone through line 24 and pass into a scrubber 25 mounted on the coking reactor. If desired, a stream of heavy material condensed in the scrubber may be recycled to the coking reactor via line 26. The coker conversion products are removed from scrubber 25 via line 28 for fractionation in a conventional manner. In heater 2, stripped coke from coking reactor 1 (commonly called cold coke) is introduced by line 18 to a fluid bed of hot coke having an upper level indicated at 30. The bed is partially heated by passing a hotter fuel gas into the heater by line 32. Supplementary heat is supplied to the heater by coke circulating in line 34. The gaseous effluent of the heater including entrained solids passes through a cyclone which may be a first cyclone 36 and a second cyclone 38 wherein separation of the larger entrained solids occurs. The separated larger solids are returned to the heater bed via the respective cyclone diplegs. The heated gaseous effluent which still contains entrained solids fines is removed from heater 2 via line 40. The fines removal system will be subsequently described herein.

Hot coke is removed from the fluidized bed in heater 2 and recycled to coking reactor by line 42 to supply heat thereto. Another portion of coke is removed from heater 2 and passed by line 44 to a gasification zone 46 in gasifier 3 in which is maintained a bed of fluidized coke having a level indicated at 48. If desired, a purge stream of coke may be removed from heater 2 by line 50.

The gasification zone is maintained at a temperature ranging from about 1500° to about 2,000° F., and a pressure ranging from about 5 to about 150 psig, preferably at a pressure ranging from about 10 to 60 psig, and more preferably at a pressure ranging from about 25 to about 45 psig. Steam by line 52 and an oxygen-containing gas such as air, commercial oxygen or air enriched with oxygen by line 54 are passed via line 56 into gasifier 3. Reaction of the coke particles in the gasification zone with the steam and the oxygen-containing gas produces a hydrogen and carbon monoxide-containing fuel gas. The gasifier product fuel gas, which may further contain some entrained solids, is removed overhead from the gasifier 3 by line 32 and introduced into heater 2 to provide a portion of the required heat as previously described.

Returning to line 40, the heater gaseous effluent containing entrained solids is passed via line 40, if desired, through an indirect heat exchanger 58 and then into a tertiary cyclone 60 in which a portion of the entrained solids is separated and removed from the cyclone as dry fines by line 62. The fines collected in cyclone 60 are pneumatically transported to the coker. The pressure required to transport the fines to the coker can be readily calculated. The desired pressure may be obtained by several means. For example, the unit may be initially designed so that the fines hopper is operated at 3 to 10 psig above the pressure in the coker at the desired injection point. Alternatively, a standpipe may be used to increase the pressure. In the present embodiment, the dry fines are introduced by line 62 into a hopper 80. The cyclone may be enclosed in the hopper. The dry fines have a particle size ranging up to about 74 microns in diameter, typically ranging up to about 35 microns in diameter with an average size of about 8 microns in diameter. Hopper 80 is subsequently blocked off from cyclone 60 and a transport gas such as nitrogen is introduced into the hopper via line 81 until the pressure in the hopper ranges from about 3 to about 10 psi above the actual pressure maintained in coker 1. Any gas that will not adversely affect the coking process may be used as transport gas. Suitable transport gases include natural gas, fuel gas, methane, nitrogen, flue gas. Steam may be used if the temperature is maintained above the dew point. For simplicity of description, nitrogen will hereinafter be used to designate the transport gas. After the desired pressure has been obtained, a portion of dry coke fines is removed from hopper 80 by line 84. The pressure in the hopper while drawing off fines is maintained in the range of about 20 to about 50 psig (or 3 to 15 psi above the actual coker pressure). Nitrogen is introduced into the fines removal line 84 by line 86. The mixture of nitrogen and dry fines is then passed into line 88. Additional nitrogen is introduced into line 88 by line 90 and line 91. The nitrogen is introduced into line 88 by line 90 at a rate sufficient to transport the fines to the coker. The mixture of nitrogen and dry fines is passed by line 88 into the dense fluidized bed maintained in coker 1. The velocity of injection into the bed must be at least about 25 feet per second, preferably at least about 150 feet per second to assure dispersion of the fines over the fluidized solids in the coker. The injection point of the dry fines-nitrogen mixture should be far enough from the top or from the bottom of the fluidized coking zone bed to permit the dry fines to be collected by the wet dense fluidized solids present in the coking zone. For example, for a commercial coker having a coking zone bed height of 78 feet, a preferred fines injection point could be about 5 to about 10 feet from the top or from the bottom of the dense fluidized coking zone bed. The preferred injection point would be near the middle of the bed, e.g. 30 feet from the top or bottom of the bed to allow the fines to be injected at the maximum rate without carry over of fines to the scrubber of the coker or to the heater. For example, suitable rates of injection include 1.4 pounds of fines per cubic foot of coking zone bed or 0.027 pound in fines per pound of coking zone bed.

A gaseous hydrogen and carbon monoxide-containing stream including the remaining entrained solids is removed from cyclone 60 by line 64 and passed to a wet scrubber 66 such as, for example, a venturi scrubber, a packed bed, a wet cyclone or other conventional equipment, in which the solids-containing gas is scrubbed with a liquid introduced by line 68. The scrubbed fuel gas is recovered by line 69. At least a portion of the solids present in gaseous stream 64 is separated from the gas to form, with the scrubbing liquid, a dilute solids-liquid slurry, which is removed from the scrubber by line 70.

What is claimed is:

1. In a coking process comprising the steps of:

a. contacting a carbonaceous material under fluid coking conditions in a coking zone containing a first bed of fluidized solids to form coke, said coke depositing on said fluidized solids;

b. introducing a portion of said solids with a coke deposition thereon to a second zone containing a second bed of fluidized solids;

c. recovering from said second zone a gaseous stream containing entrained solid fines; and d. separating at least a portion of said fines from said gaseous stream as dry fines having a particle size ranging up to about 74 microns, the improvement which comprises:

e. mixing said portion of said separated dry fines with a gas, said portion of said separated dry fines consisting entirely of particles not greater than 74 microns, and f. introducing the resulting mixture of dry fines and gas into said coking zone at a velocity of at least 25 feet per second, said dry fines in said mixture consisting entirely or particles not greater than 74 microns.

2. The process of claim 1 wherein said mixture of dry fines and gas is introduced into said coking zone at a velocity of at least 150 feet per second.

3. The process of claim 1 wherein said mixture of dry fines and gas is introduced into an intermediate portion of said coking zone.

4. The process of claim 1 wherein said gas of step (e) is selected from the group consisting of nitrogen, fuel gases, natural gas, methane, flue gas and steam.

5. The process of claim 1 wherein said gas of step (e) is nitrogen.

6. The process of claim 1 wherein said second zone is a combustion zone.

7. The process of claim 1 wherein said second zone is a heat exchange zone.

8. The process of claim 1 wherein said second zone is a gasification zone.

9. In an integrated coking and gasification process for the production of coke and a gaseous stream containing hydrogen and carbon monoxide, comprising the steps of:

a. reacting a carbonaceous material having a Conradson carbon content of at least 5 weight percent in a coking zone containing a bed of fluidized solids maintained at a temperature ranging from about 850° to about 1400° F. to form coke, said coke depositing on said fluidized solids;

b. introducing a portion of said solids with a coke deposition thereon into a heating zone operated at a temperature greater than said coking zone temperature to heat said portion of solids;

c. recycling a first portion of heated solids from said heating zone to said coking zone;

d. introducing a second portion of said heated solids to a fluid bed gasification zone maintained at a temperature greater than the temperature of said heating zone;

e. reacting said second portion of said heated solids in said gasification zone with steam and an oxygen-containing gas to produce a hot gaseous stream containing hydrogen and carbon monoxide;

f. introducing said hot gaseous stream containing hydrogen and carbon monoxide and entrained fines into said heating zone;

g. passing an additional stream of solids from said gasification zone to said heating zone;

h. recovering from said heating zone the resulting cooled gaseous stream containing hydrogen and carbon monoxide and entrained fines;

i. separating from said hydrogen and carbon monoxide-containing gaseous stream at least a portion of said entrained fines as dry fines having a particle size ranging up to about 74 microns, the improvement which comprises:

j. mixing said portion of said separated dry fines with a transport gas, said portion of said separated dry fines consisting entirely of particles not greater than 74 microns, and k. introducing the resulting mixture of dry fines and transport gas into said coking zone at a velocity of at least about 25 feet per second, said dry fines in said mixture consisting entirely of particles not greater than 74 microns.

10. The process of claim 9 wherein said mixture of dry fines and transport gas is introduced into said coking zone at a velocity of at least about 150 feet per second.

11. The process of claim 9 wherein said mixture of dry fines and transport gas is introduced into an intermediate portion of said coking zone.

12. The process of claim 9 wherein said transport gas is selected from the group consisting of nitrogen, steam fuel gases and flue gas.

13. The process of claim 1 wherein said dry fines have a particle size ranging up to 35 microns in diameter.

14. The process of claim 1 wherein said dry fines have an average particle size of about 8 microns in diameter.

15. The process of claim 9 wherein said dry fines have a particle size ranging up to 35 microns in diameter.

16. The process of claim 9 wherein said dry fines have an average particle size of about 8 microns in diameter.

* * * * *